US006976887B2

(12) United States Patent
Shigeta et al.

(10) Patent No.: US 6,976,887 B2
(45) Date of Patent: Dec. 20, 2005

(54) LEVER-FITTING CONNECTOR ASSEMBLY

(75) Inventors: Yoshinori Shigeta, Shizuoka-ken (JP); Tetsuya Yamashita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/994,354

(22) Filed: Nov. 23, 2004

(65) Prior Publication Data

US 2005/0142912 A1 Jun. 30, 2005

(30) Foreign Application Priority Data

Nov. 28, 2003 (JP) ..... 2003-399623

(51) Int. Cl.[7] ..... H01R 9/22
(52) U.S. Cl. ..... 439/717; 439/157
(58) Field of Search ..... 439/157, 372, 439/701, 717

(56) References Cited

U.S. PATENT DOCUMENTS 6,113,415 A * 9/2000 Bertsch et al. ..... 439/353
6,176,713 B1 * 1/2001 Okabe ..... 439/157
6,193,550 B1 * 2/2001 Yamashita et al. ..... 439/594
6,332,788 B1 * 12/2001 Okabe et al. ..... 439/157
6,332,813 B1 * 12/2001 Okabe et al. ..... 439/701
6,352,440 B1 * 3/2002 Okabe et al. ..... 439/157
6,375,517 B1 * 4/2002 Okabe et al. ..... 439/701
6,447,344 B2 * 9/2002 Sato et al. ..... 439/701
6,796,815 B2 * 9/2004 Okabe et al. ..... 439/157

FOREIGN PATENT DOCUMENTS

JP 2002-280111 9/2002
JP 2002-359028 12/2002

* cited by examiner

*Primary Examiner*—Hae Moon Hyeon
(74) *Attorney, Agent, or Firm*—Finnegan, Henderson, Farabow, Garrett & Dunner, L.L.P.

(57) ABSTRACT

The lever-fitting connector assembly includes a first connector. The first connector includes a first terminals arranged at intervals. The first connector includes a hood enclosing the first terminals. The assembly includes a second connector fitted to the hood. The second connector includes second terminals connected to the first terminals. The second connector includes connector components joined to each other, and having joint surfaces in a fitting direction, respectively. The assembly includes a lever rotatable on one of the first and second connectors to fit to the other one of the first and second connectors. The assembly includes a locking mechanism for locking the connector components with each other. The locking mechanism includes a resilient member contactably and separatably retaining the connector components within a clearance normal to the joint surfaces opposed to each other.

4 Claims, 4 Drawing Sheets

LEVER-FITTING CONNECTOR ASSEMBLY

CROSS-REFERENCE TO RELATED APPLICATIONS

This application is based upon and claims the benefit of priority from Japanese Patent Application No. 2003-399623 filed on Nov. 28, 2003; the entire contents of which are incorporated herein by reference.

BACKGROUND OF THE INVENTION

The present invention relates to a lever-fitting connector assembly which allows a connector and a mating connector to be fitted to each other by rotating a lever provided on the former connector. More particularly, the invention relates to an assembly structure formed by assembling a connector having a lever and other connectors together.

This invention is applied in a field of producing a connection device of wires.

The lever-fitting connector assembly includes a female connector having a fitting hood. This connector includes a male connector having a male connector body which is fitted into and disengaged from the fitting hood. The connector includes a lever which is rotatably supported by the inner wall of the fitting hood or the outer periphery of the male connector (e.g., Japanese Patent Applications Laid-open Nos. 2002-280111 and 2002-359028). According to this connector, the rotating motion of the lever allows the male connector body to fit into the fitting hood or allows the male connector body to be disengaged from the fitting hood.

In this connector, the connector body is fitted into the fitting hood, and a male terminal housed in a male connector and a female terminal housed in a female connector are connected to each other. The connection between these terminals is released by separating of the male connector body from the fitting hood. In this case, an insertion force for inserting the male connector into the female connector is reduced by a lever using this principle.

In this connector, in order to obtain a waterproof function, a seal member is interposed between the outer peripheral surface of the connector body and the inner peripheral surface of the fitting hood. A waterproof hood is provided on each of an outer side of the hood of the female connector and an outer side of the male connector body (outer side of the lever). The waterproof hood covers fitted portions between the fitting hood and the male connector body.

SUMMARY OF THE INVENTION

The waterproof connector, however, is separated into a first connector component and a second connector component. In order to divide the connector, it is necessary to secure a waterproof seal surface between the mutually fitted connectors. This requires a further enhancement of size precision, or requires an absorbing structure of cumulative tolerance of terminal pitch.

It is an object of the present invention to provide a lever-mating connector assembly having excellent waterproof performance and capable of reliably absorb the cumulative pitch tolerance generated between connector components which are to be assembled to each other.

The first aspect of the invention provides the following lever-fitting connector assembly. The assembly includes a first connector. The first connector includes a first terminals arranged at intervals. The first connector includes a hood enclosing the first terminals. The assembly includes a second connector fitted to the hood. The second connector includes second terminals connected to the first terminals. The second connector includes connector components joined to each other, and having joint surfaces in a fitting direction, respectively. The assembly includes a lever rotatable on one of the first and second connectors to fit to the other one of the first and second connectors. The assembly includes a locking mechanism for locking the connector components with each other. The locking mechanism includes a resilient member contactably and separatably retaining the connector components within a clearance normal to the joint surfaces opposed to each other.

The resilient member may include engagement arms projecting obliquely from one to the other one of the joint surfaces. The engagement arms become farther from each other as the engagement arms extend from said one of the joint surfaces. The locking mechanism may include an engagement channel defined by the other one of the joint surfaces for housing and retaining the engagement arms.

The engagement channel may extend in the fitting direction. The engagement arms project in a direction of fitting the first and second connectors.

The locking mechanism may include a lock arm on one of the joint surfaces. The locking mechanism includes a lock hole on the other one of the joint surfaces. The lock arm and the lock hole are locked with each other to retain the joint surfaces to each other.

BRIEF DESCRIPTION OF THE ACCOMPANYING DRAWINGS

DETAILED DESCRIPTION OF THE PREFERRED EMBODIMENTS

A lever-fitting connector assembly of an embodiment will be described below.

Figure 1:
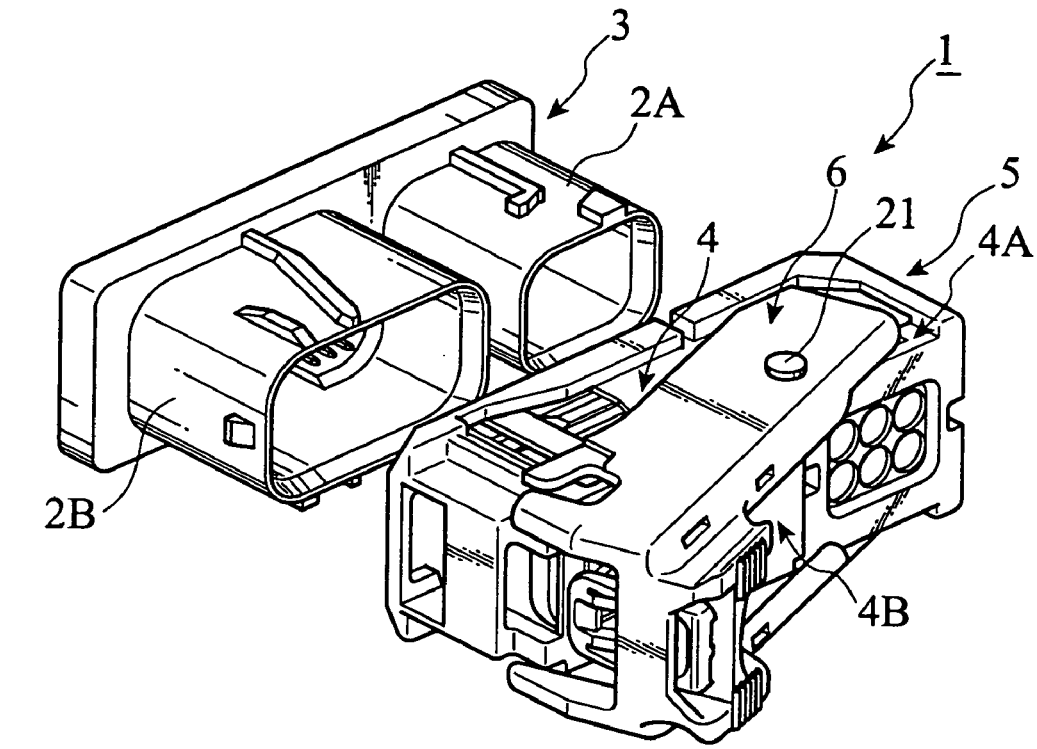
FIG. 1 is a perspective view of a lever-fitting connector assembly according to an embodiment of the present invention.

In FIG. 1, the lever-fitting connector assembly 1 includes a female connector 3, a male connector 5 and a lever 6.

Figure 4:
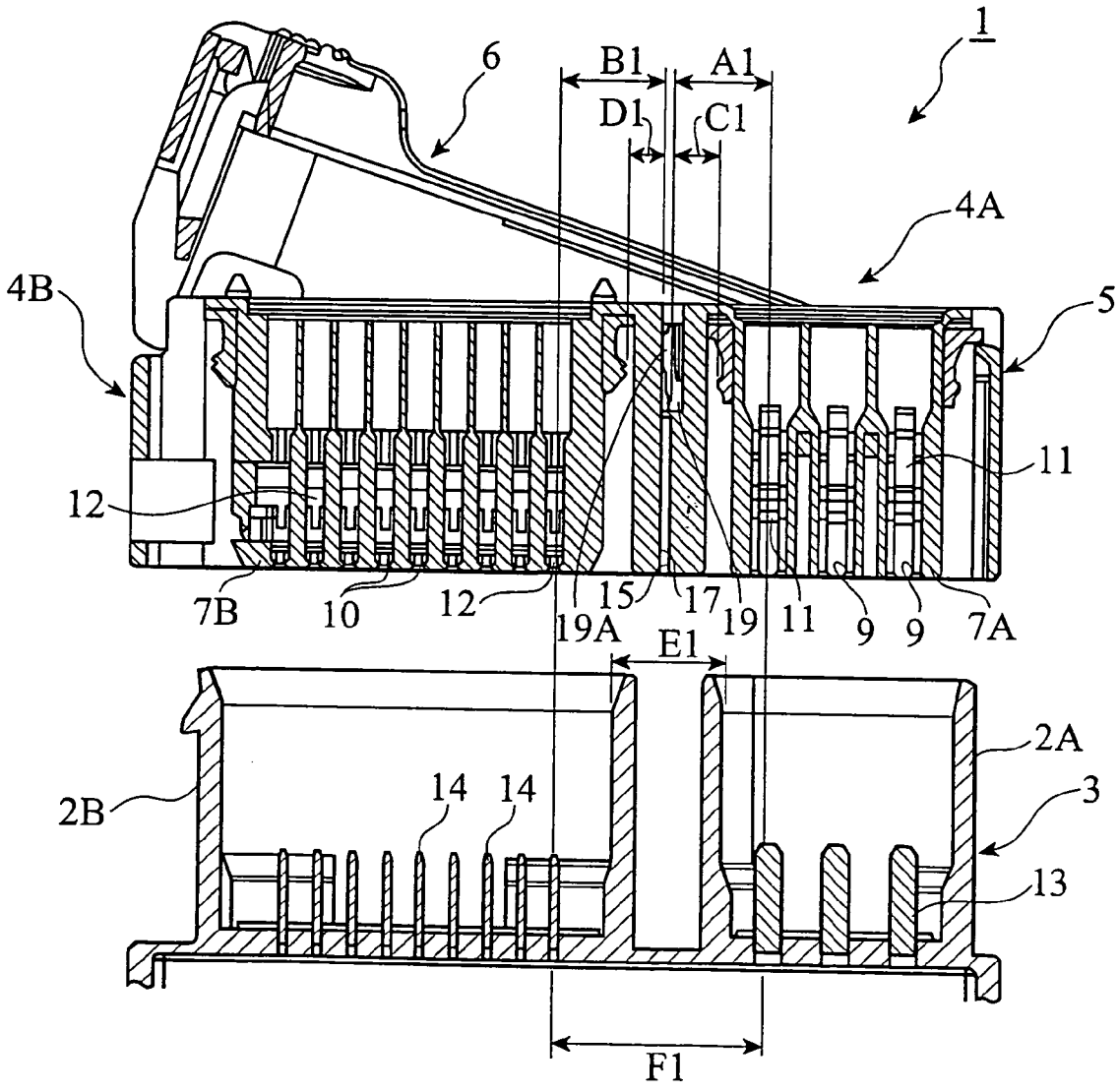
FIG. 4 is a sectional view of the separate connectors shown in FIG. 1.

In FIG. 4, the female connector 3 includes female connector connecting terminals 13 and 14 arranged at respective predetermined pitches from one another. The female connector 3 includes fitting hoods 2A and 2B which surround the entire connecting terminals 13 and 14.

The male connector 5 is fitted to the fitting hoods 2A and 2B of the female connector 3. The male connector 5 includes male connector connecting terminals 11 and 12 arranged at predetermined pitches from one another. The male connector connecting terminals 11 and 12 are fitted and connected to the connecting terminals 13 and 14.

In FIG. 1, the lever 6 is rotatably supported by the male connector 5. The male connector 5 and the female connector 3 are fitted to and disengaged from each other by rotating the lever 6. The lever 6 is operated to rotate, with an end thereof latched into the female connector 3. The lever 6 has a function for reducing a force that is required to fit and separate the female connector 3 and the male connector 5 to and from each other using the action of the lever.

Figure 2:
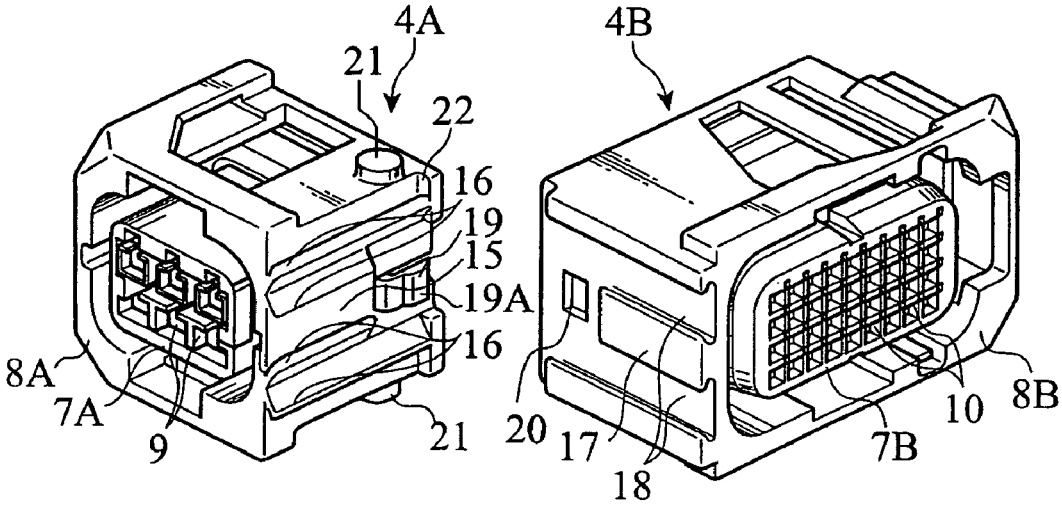
FIG. 2 is a perspective view showing separate connector bodies.

Specifically in this embodiment, the male connector 5 includes connector components 4A and 4B which are connected to each other. In FIG. 2, the connector components 4A and 4B have joint surfaces 15 and 17 extending along the fitting direction. The joint surfaces 15 and 17 are contactably and separatably retained in a predetermined length range in a direction perpendicular to the joint surfaces 15 and 17 due to repulsive deflection of engagement projections 16 as resilient members.

Each of the engagement projections 16 has a pair of arms 16*a* and 16*b* that extend oppositely and obliquely from one to the other of the joint surfaces 15 and 17 of the neighboring connector components 4A and 4B. Arms 16*a* and 16*b* are spread and opened into a substantially V-shape. The arms 16*a* and 16*b* have a spacing therebetween that becomes greater as the arms 16*a* and 16*b* extend from the one of the joint surfaces 15 and 17. The other one of the joint surfaces 15 and 17 has engagement channels 18 for housing and retaining engagement projections 16. With the engagement projections 16 housed in the engagement channels 18, the joint surfaces 15 and 17 establish a clearance S1 set therebetween. The structure allows change in distance between neighboring joint surfaces 15 and 17, with repulsion produced by deflections of the engagement projections 16.

Next, the lever-fitting connector assembly 1 of the embodiment of the invention will be specifically described.

With reference to FIG. 1, the lever-fitting connector assembly 1 includes the female connector 3 having the pair of fitting hoods 2A and 2B. The connector 1 includes the male connector 5 having the male connector body 4 fitted into the fitting hoods 2A and 2B. The connector 1 includes the lever 6 rotatably supported by the male connector 5. The lever 6 is rotated to fit and separate the male connector 5 and the female connector 3 each other.

In FIG. 2, the male connector body 4 includes the assembled first connector component 4A and the second connector component 4B. The first and the second connector components 4A and 4B include connector insertion parts 7A and 7B which are fitted into the fitting hoods 2A and 2B, respectively. The connector components 4A and 4B respectively include waterproof hoods 8A and 8B which cover outer peripheries of the connector insertion parts 7A and 7B. The waterproof hoods 8A and 8B and the connector insertion parts 7A and 7B have predetermined clearances therebetween, respectively. With the connector insertion parts 7A and 7B are fitted into the fitting hoods 2A and 2B, the waterproof hoods 8A and 8B cover and tight contact outer sides of the fitting hoods 2A and 2B. As shown in FIGS. 1 and 2, the first connector component 4A includes rotation shafts 21 at predetermined positions on the both upper and lower surfaces of first connector component 4A. The rotation shafts 21 project for rotatably supporting the lever 6. The first connector component 4A is provided at the rear portion with a fitting-load receiving part 22 which abuts against the second connector component 4B.

As shown in FIG. 2, the connector insertion parts 7A and 7B are provided at their front surfaces in the fitting direction with terminal inserting holes 9 and 10. The terminal insertion holes 9 and 10 are arranged at predetermined distances from one another of a predetermined layout. In FIG. 4, the connecting terminals 11 and 12 are arranged in the terminal insertion holes 9 and 10.

In FIG. 4, the female connector 3 includes the connecting terminals 13 and 14 arranged at the inner bottoms of the fitting hoods 2A and 2B in coincidence with the connecting terminals 11 and 12 in the connector insertion parts 7A and 7B.

Next, a connecting structure of the first and the second connector components 4A and 4B constituting the male connector body 4 will be explained.

As shown in FIG. 2, the first connector component 4A includes the waterproof hood 8A having the joint surface 15. The joint surface 15 includes a pair of engagement projections 16 as resilient members or a locking mechanism. Engagement projections 16 extend in parallel to each other along the fitting direction. Each of engagement projections 16 includes arms 16*a* and 16*b*. The arms 16*a* and 16*b* are obliquely spread and opened into a substantially V-shaped cross section. The arms 16*a* and 16*b* extend obliquely from the joint surface 15 in opposite directions from each other. The arms 16*a* and 16*b* have a spacing therebetween that becomes greater as the arms 16*a* and 16*b* extends away from the joint surface 15.

The second connector component 4B includes the joint surface 17. The second connector component 4B includes two engagement channels 18 as a locking mechanism formed in the fitting direction. The engagement channels 18 house the engagement projections 16 on the side of the first connector component 4A, respectively. The engagement channel 18 includes both sidewalls 18*a* in the transverse direction. Each of the sidewalls 18*a* has an inclined surface 18*b* which overhangs in accordance with inclination of the engagement projection 16. Therefore, when the pair of engagement projections 16 is housed in the engagement channels 18, the engagement projections 16 are not disengaged from the engagement channels 18.

Figure 3:
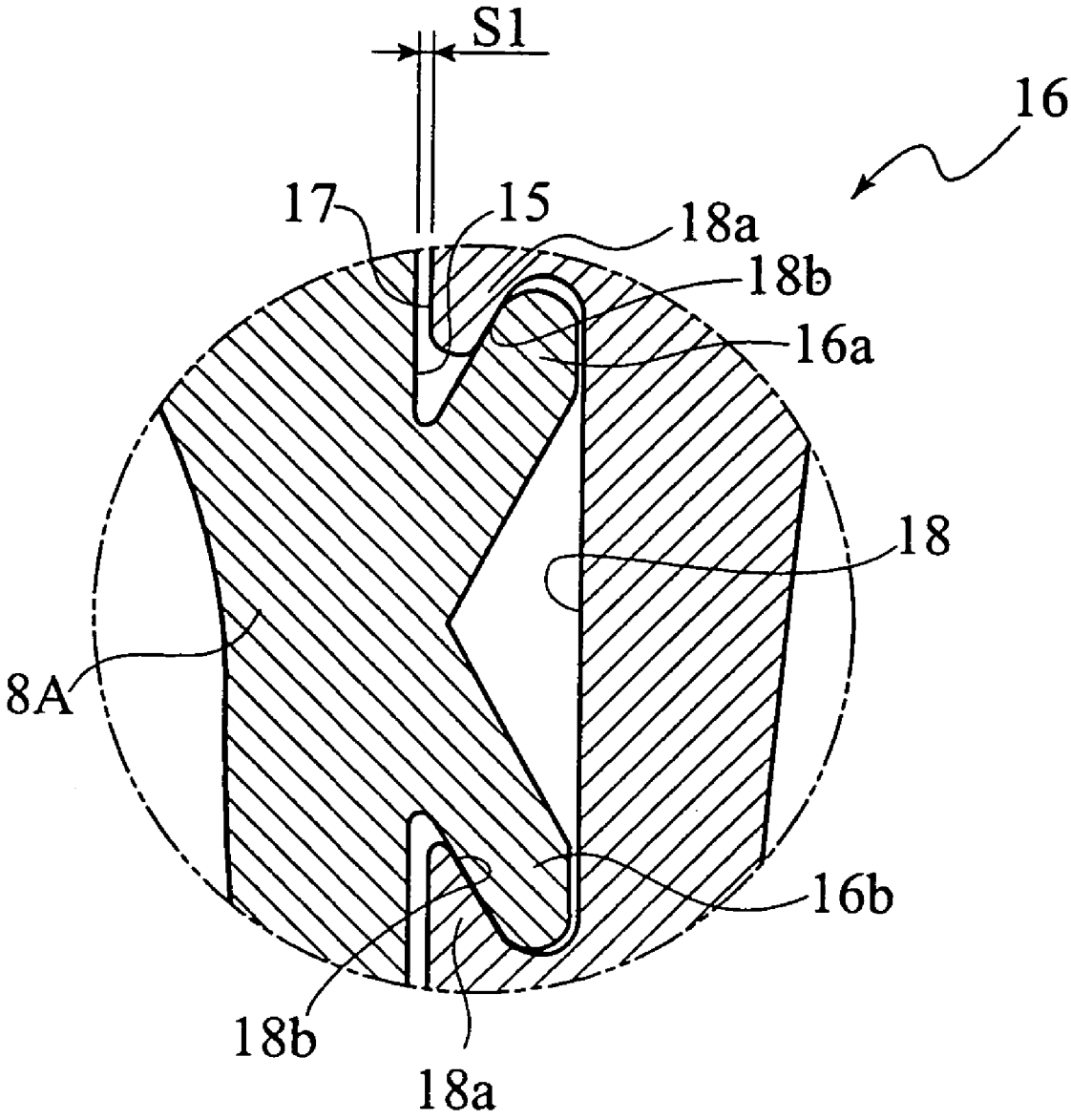
FIG. 3 is a sectional view of an essential portion showing a connected portion of the connector bodies shown in FIG. 1.

In this embodiment, shown specifically in FIG. 3, a predetermined clearance S1 is formed between the joint surfaces 15 and 17, with the engagement projections 16 housed in the engagement channels 18. This structure permits variations in the clearance S1 between the neighboring joint surfaces 15 and 17, using the repulsion produced by deflection of the engagement projection 16.

In FIG. 2, a lock arm 19 as a locking mechanism is provided between rear ends of the pair of engagement projections 16 on the joint surface 15 of the first connector component 4A in the fitting direction. The lock arm 19 is a plate piece having repulsion and is integrally formed on the waterproof hood 8A. The lock arm 19 projects obliquely from the joint surface 15 in the coupling direction. The lock arm 19 includes a lock projection 19A. The second connector component 4B includes a lock hole 20 as a locking mechanism into which the projection 19A is fitted. When the projection 19A is fitted into the lock hole 20, the first connector component 4A and the second connector component 4B are appropriately positioned.

The operation and effect of the lever-fitting connector assembly 1 will be described below.

The engagement projections 16 and the engagement channels 18 formed on and in the first and the second connector components 4A and 4B are arranged along the fitting direction of the female connector 3 and the male connector 5 side-by-side. According to this arrangement, fitting loads of the first and the second connector components 4A and 4B are separated from each other while fitting the male connector 5 into the female connector 3, and the set clearance S1 can be used comfortably.

The lever-fitting connector assembly 1 has a distance A1 from the joint surface 15 of the first connector component 4A to one of the connecting terminals 11 that is closest to the joint surface 15. This distance is maintained by engaging of the projection 19A with the lock hole 20 formed in the joint surface 17 of the second connector component 4B. This structure prevents the incomplete assembly between the first connector component 4A and the second connector component 4B, and allows the male connector 5 to be securely fitted into the female connector 3.

The engagement projections 16 as resilient members contactably and separatably retain the first and the second connector components 4A and 4B within a predetermined length range perpendicular to the joint surfaces 15 and 17 (because the clearance S1 is set). This structure absorbs the cumulative tolerance of the terminal pitch with this clearance S1, allowing the male connector 5 and the female connector 3 to be fitted to each other without undue stress.

More specifically, as shown in FIG. 4, the distance A1 represents one from the joint surface 15 of the first connector component 4A to one of the connecting terminals 11 that is closest to the joint surface 15. The distance B1 represents one from the joint surface 17 to the closest connecting terminal 12. The distance C1 represents one from the joint surface 15 of the first connector component 4A to a seal surface of the connector insertion parts 7A that is closest to the joint surface 15. The distance D1 represents one from joint surface 17 to the seal surface of the closest connector insertion parts 7B. The distance E1 represents one between the seal surfaces of the adjacent fitting hoods 2A and 2B. The distance F1 represents the shortest distance between the connecting terminals 13 and 15 of the fitting hoods 2A and 2B. Since the distances A1 and C1 are completely separated from the distance B1, the cumulative pitch tolerance is absorbed by the clearance S1. That is, the degree of precision of the seal surface on the side of the female connector 3 is low. Even if the distance E1 has low precision, the first and the second connector components 4A and 4B are fixed to each other through the clearance S1 by the male connector body 4, thus absorbing the cumulative pitch tolerance.

The male connector 5 is fitted into the female connector 3 without undue stress. This structure allows the male connector 5 to normally fit into the fitting hoods 2A and 2B of the female connector 3. Therefore, the water proof lever-fitting connector assembly 1 has a seal surface formed by the inner peripheral surfaces of the fitting hoods 2A and 2B of the female connector 3 and outer peripheral surfaces of the connector insertion parts 7A and 7B of the male connector 5, thus enhancing the waterproof effect.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

According to this arrangement, fitting loads of the first and the second connector components 4A and 4B are separated from each other while fitting the male connector 5 into the female connector 3, and the set clearance S1 can be used comfortably.

The lever-fitting connector assembly 1 has a distance A1 from the joint surface 15 of the first connector component 4A to one of the connecting terminals 11 that is closest to the joint surface 15. This distance is maintained by engaging of the projection 19A with the lock hole 20 formed in the joint surface 17 of the second connector component 4B. This structure prevents the incomplete assembly between the first connector component 4A and the second connector component 4B, and allows the male connector 5 to be securely fitted into the female connector 3.

According to the invention, the resilient member contactably and separatably retains the connector components within a predetermined clearance normal to the joint surfaces. This structure absorbs the cumulative tolerance of the terminal pitch with this clearance, allowing the first and second connectors to be fitted to each other without undue stress.

The first and second connectors are fitted to each other without undue stress. This structure allows the second connector to normally fit into the hood of the first connector. Therefore, the water-proof lever-fitting connector assembly has a seal surface formed by the inner peripheral surface of the hood of the first connector and the outer peripheral surface of the second connector, thus enhancing the waterproof effect.

The engagement arms served as a resilient member and the engagement channel for housing the engagement arms are formed in a fitting direction. The resilient member allows a clearance between the neighboring joint surfaces to be effectively changed, without separating of fitting-load.

The lock arm and the lock channel on the joint surfaces allow positioning of the connector components, preventing incomplete assembly between the connector components. This achieves secure fitting and joint.

What is claimed is:

1. A lever-fitting connector assembly comprising:

a first connector comprising:

a first terminals arranged at intervals; and a hood enclosing the first terminals;

a second connector fitted to the hood, the second connector comprising:

second terminals connected to the first terminals; and connector components joined to each other, and having joint surfaces in a fitting direction, respectively;

a lever rotatable on one of the first and second connectors to fit to the other one of the first and second connectors; and a locking mechanism for locking the connector components with each other, the locking mechanism comprising: a resilient member contactably and separatably retaining the connector components within a clearance normal to the joint surfaces opposed to each other.

2. The lever-fitting connector assembly of claim 1, wherein the resilient member comprises engagement arms projecting obliquely from one to the other one of the joint surfaces, wherein the engagement arms become farther from each other as the engagement arms extend from said one of the joint surfaces, wherein the locking mechanism comprises an engagement channel defined by the other one of the joint surfaces for housing and retaining the engagement arms.

3. The lever-fitting connector assembly of claim 2, wherein the engagement channel extends in the fitting direction, wherein the engagement arms project in a direction of fitting the first and second connectors.

4. The lever-fitting connector assembly of claim 1, wherein the locking mechanism comprises:

a lock arm on one of the joint surfaces; and a lock hole on the other one of the joint surfaces, wherein the lock arm and the lock hole are locked with each other to retain the joint surfaces to each other.

* * * * *